US008322563B2

(12) United States Patent
Gold et al.

(10) Patent No.: US 8,322,563 B2
(45) Date of Patent: Dec. 4, 2012

(54) INFANT DRINKING CUP

(75) Inventors: Jonathan Morris Gold, London (GB); Daniel Jason Tyler, Milton Keynes (GB)

(73) Assignee: Brother Max Limited, Borehamwood (GB)

( * ) Notice: Subject to any disclaimer, the term of this patent is extended or adjusted under 35 U.S.C. 154(b) by 265 days.

(21) Appl. No.: 12/600,869

(22) PCT Filed: May 19, 2008

(86) PCT No.: PCT/GB2008/001720

§ 371 (c)(1), (2), (4) Date: Nov. 19, 2009

(87) PCT Pub. No.: WO2008/142399

PCT Pub. Date: Nov. 27, 2008

(65) Prior Publication Data

US 2010/0155403 A1 Jun. 24, 2010

(30) Foreign Application Priority Data

May 24, 2007 (GB) ..... 0709927.8

(51) Int. Cl.
*B65D 81/24* (2006.01)

(52) U.S. Cl. ..... 220/756; 220/771; 220/710.5; 220/752

(58) Field of Classification Search ..... 220/756, 220/771, 717, 317, 710.5, 752, 758, 769; 215/11.1, 11.4, 11.6

See application file for complete search history.

(56) References Cited

U.S. PATENT DOCUMENTS

| | | | | |
|---|---|---|---|---|
| 2,671,326 | A | 3/1954 | Pickering et al. | |
| 2,981,562 | A * | 4/1961 | Long | 294/31.2 |
| 3,315,803 | A * | 4/1967 | Kalajian | 206/216 |
| 3,717,288 | A * | 2/1973 | Schlegel | 222/465.1 |
| 4,016,998 | A | 4/1977 | Finch | |
| 4,094,449 | A * | 6/1978 | Schlegel et al. | 222/475 |
| 5,211,307 | A * | 5/1993 | Jeffries | 220/739 |
| 6,968,888 | B2 * | 11/2005 | Kolowich | 165/10 |
| 2001/0036124 | A1 * | 11/2001 | Rubenstein | 366/205 |
| 2003/0136269 | A1 | 7/2003 | Chen | |
| 2004/0035815 | A1 * | 2/2004 | Webb et al. | 215/11.4 |
| 2005/0178775 | A1 | 8/2005 | Burke et al. | |
| 2006/0213855 | A1 * | 9/2006 | Kraus et al. | 215/11.1 |

FOREIGN PATENT DOCUMENTS

| | | | |
|---|---|---|---|
| DE | 3021110 | A1 | 12/1981 |
| DE | 3422441 | A1 | 6/1984 |
| DE | 29514091 | U1 | 11/1995 |
| GB | 2418834 | A | 4/2006 |
| WO | WO 2004/100736 | A | 11/2004 |

* cited by examiner

*Primary Examiner* — Mickey Yu
*Assistant Examiner* — Kareen Rush

(57) ABSTRACT

There is provided an infant drinking cup (1) comprising a cup-shaped container (10) having a base from which upwardly extends side walling (14), which side walling (14) defines a mouth of said cup-shaped container. The side walling (14) centers about an axis that extends at an angle from normal to the container base (12) such that the cup-shaped container (10) has a leaning form. The cup-shaped container is provided with one or more handles (30) extending from a lower portion of the cup-shaped container (10) to an upper portion thereof such that said one or handles (30) support the cup-shaped container (10) to prevent accidental tipping over thereof.

8 Claims, 7 Drawing Sheets

INFANT DRINKING CUP

TECHNICAL FIELD

The present invention relates to an infant drinking cup of the type that is of use in training a toddler to drink liquids from a cup.

BACKGROUND TO THE INVENTION

Infant drinking cups of the type that are of use in training a toddler to drink liquids from a cup are well-known in the art. Such drinking cups typically comprise a cup-shaped container, to which is provided a reversibly removable lid, to which is provided a spout. The spout is suitably provided with a one-way valve means arranged such that liquid may only be dispensed through the spout in response to action of the child. Most commonly the one-way valve is responsive to either sucking action of the child (e.g. a slit valve) or the spout has a flexible character and opening of the one-way valve is in response to squeezing action (e.g. by the child's lips or teeth) at the spout body.

It is appreciated in the art that such infant drinking cups constitute a different type of product than baby feeding bottles, which are used for feeding babies with milk or other liquids ('baby bottles'). Such feeding bottles generally comprise a bottle container, to which is provided a soft teat that reversibly fixes to a rim of the bottle container by means of a fixing ring. A protective lid is generally also provided to the feeding bottle for covering the soft teat when the feeding bottle is not in use. Such baby feeding bottles are used for feeding very young children (i.e. babies) rather than the training toddlers for whom the present infant drinking cup is intended. Such baby feeding bottles are also most commonly used under the control of a parent or carer who holds the bottle and places the teat in the baby's mouth. By contrast, the infant drinking cups herein are designed to be provided to the training toddler largely for use under their independent control.

Much of the prior art relating to infant drinking cups has tended to focus on preventing leakage of liquids, particularly through the spout. Thus, many 'one way valve' solutions to this problem has been put forward, of which EP 634,922 B1 and EP 858,275 B1 of Mandy Nicola Haberman and WO 03/101,261 of Jackel International Ltd are but examples.

Applicant has now realized that other aspects of the generally accepted form of infant drinking cups may be improved such as to enhance the utility and user-friendliness thereof.

In one aspect, known infant drinking cups typically comprise a cup-shaped container having a base from which upwardly extends a circular side wall, which side wall is provided at its uppermost end with a rim that defines the mouth opening of the cup-shaped container. The lid is then provided to that rim with which it interacts in a reversibly sealable manner (e.g. snap-fit). One or more (generally, two) handles then extend from that side wall to assist the child with picking up the cup for drinking therefrom. Conventionally, the circular side wall centres about an axis that extends normal to the container base such that the cup has 'upright' form and defines a centre of gravity generally along that axis. Applicant has now appreciated that it is beneficial if instead the side wall centres about an axis that extends at angle from the normal to the container base such that the cup has a 'leaning' or 'tilted' form and an offset centre of gravity. Such 'leaning' or 'tilted' form has been found to make it easier for the child to tip the cup towards themselves for drinking therefrom. In essence, it assists the ergonomics of 'tipping up' of the cup for drinking.

One problem with such a 'leaning' or 'tilted' form is that without support the cup-shaped container is also more susceptible to tipping over. One partial solution to this problem is to build up the base such as by providing the base with a stand (e.g. defining a supportive rim). Whilst this assists stability when the cup is not in use, it does not effectively prevent tipping up of a cup that has been clumsily reached for by a child user. Applicant has now therefore devised an alternative solution in which one or more (generally two) handles extend from a lower portion of the cup (e.g. the base) and around to an upper portion (e.g. the rim) wherein those handles define a resting support portion that acts to prevent tipping over of the cup. It will be appreciated that generally the handles extend in or about the direction to which the cup inclines and are arranged to define supportive contact with a support surface (e.g. table top) when the cup is not in use, but also when the cup is in use, and has been tilted up by the child. In improvements, the one or more handles may also define a tipping support portion that projects away from the resting support portion and arranged to define supporting contact with a support surface when the cup-shaped container is tipped up during use thereof.

In another aspect, Applicant has appreciated that the utility of the infant drinking cup could be extended if the design thereof made it amenable to usage without the lid. Thus, in one mode of usage the child 'trains' by drinking with a lidded cup that prevent spills in their early training attempts, but as they become more proficient in the cup drinking process that lid can be taken off and the child is trusted to use an open-mouthed container.

Conventional drinking cups tend to be unsuitable for this mode of usage in that the exterior of the rim, which defines the mouth of the cup-shaped container is provided with protrusions, grooves, snap-fittings etc. for engaging with the lid and that are uncomfortable for the child's mouth to interact with. In solution to this problem, Applicant provides the means for engaging the sealing lid to the cup-shaped container interior to that container. Thus in one aspect, the interior of the cup-shaped container is provided with a screw-thread for screw-threaded sealing engagement with a sealing lid also provided with a mating screw-thread.

It is an object of the present invention to provide an infant drinking cup that has enhance utility for the infant user.

SUMMARY OF THE INVENTION

According to a first aspect of the present invention there is provided an infant drinking cup comprising a cup-shaped container having a base from which upwardly extends side walling, which side walling defines a mouth of said cup-shaped container;

wherein the side walling centres about an axis that extends at an angle from normal to the container base such that the cup-shaped container has a leaning form, and wherein the cup-shaped container is provided with one or more handles extending from a lower portion of the cup-shaped container to an upper portion thereof such that said one or handles support the cup-shaped container to prevent accidental tipping over thereof.

The infant drinking cup comprises a cup-shaped container having a base from which upwardly extends side walling, which side walling defines a mouth of said cup-shaped container. In embodiments, the side walling comprises a circular or ovular side wall, which may in embodiments taper away from the base and the mouth is correspondingly circular or ovular. In embodiments, a defined rim may be defined at the mouth of the cup-shaped container.

The side walling centres about an axis that extends at an angle from normal to the container base. Thus, the axis about which the side walling is centre is angularly offset from a normal axis to the plane defined by the container base. Thus, the cup-shaped container has a leaning (or 'tilted') form and an offset centre of gravity. Such 'leaning' or 'tilted' form has been found to make it easier for the child user to tip the cup towards themselves for drinking therefrom. In essence, it assists the ergonomics of the 'tipping up' the cup-shaped container for drinking of liquid therefrom.

In embodiments, the cup-shaped container is provided with a sealing lid that is arranged to interact in a reversibly sealable manner (e.g. snap-fit or screw-fit) with the cup-shaped container to seal off the mouth thereof.

In embodiments the sealing lid is provided with a spout arranged for the delivery of liquids therethrough. In embodiments, the spout is provided with a one-way valve arranged such that liquid may only be dispensed through the spout in response to action of the child. Most commonly the one-way valve is responsive to either sucking action of the child (e.g. a slit valve) or the spout has a flexible character and opening of the one-way valve is in response to squeezing action (e.g. by the child's lips or teeth) at the spout body (e.g. a duck bill valve).

In embodiments, the sealing lid with spout is provided with an over-lid therefor. The over-lid typically engages with a rim provided to the mouth of the cup-shaped container.

In aspects, the cup-shaped container is provided with one or more handles extending from a lower portion of the cup-shaped container to an upper portion thereof such that said one or handles support the cup-shaped container to prevent accidental tipping over thereof.

In embodiments, the one or more handles extend from the base of the cup-shaped container up and around to the mouth thereof.

In embodiments, the one or more handles project from the cup-shaped container in or about the direction in which the cup-shaped container leans.

In embodiments, the one or more handles define a resting support portion that extends in the plane defined by the base and arranged to define resting supporting contact with a planar support surface (e.g. a table top).

In embodiments, the one or more handles define a tipping support portion that projects away from said resting support portion in or about the direction in which the which the cup-shaped container leans and is arranged to define supporting contact with a planar support surface (e.g. a table top) when the cup-shaped container is tipped up following the direction of leaning during use thereof.

According to another aspect of the present invention there is provided an infant drinking cup comprising a cup-shaped container having a base from which upwardly extends side walling, which side walling defines a mouth of said cup-shaped container; and a sealing lid arranged for reversibly sealing off said mouth of the cup-shaped container, wherein the interior of the side walling of the cup-shaped container is provided with engaging means for engaging with the sealing lid.

Applicant has found that positioning the engaging means at the interior of the side walling of the cup-shaped container rather than the conventional positioning of the engaging means on the exterior of the side walling make it comfortable for the infant's mouth to interact with the mouth of the cup when the cup is used with the sealing lid removed therefrom In embodiments, the interior of the side walling of the cup-shaped container is provided with a screw-thread for screw-threaded sealing engagement with a sealing lid provided with a mating screw-thread.

It will be appreciated that any of the elements of the infant drinking cup herein may be manufactured and supplied separately and/or supplied as a pre-assembly or a kit of parts. The present invention encompasses all of these separate component parts and any assemblies thereof.

BRIEF DESCRIPTION OF THE DRAWINGS

The invention will now be described further with reference to the accompanying drawings, in which:—

Referring now to the drawings, FIG. 1 shows an infant drinking cup 1 herein, which may optionally be provided with an over-lid 40 as shown at FIGS. 2 to 4. The infant drinking cup 1 of FIG. 1 is separable into cup-shaped container 10 with lid 20 and handle defining structure 30 components as respectively shown in FIGS. 5 and 6.

Figure 1:
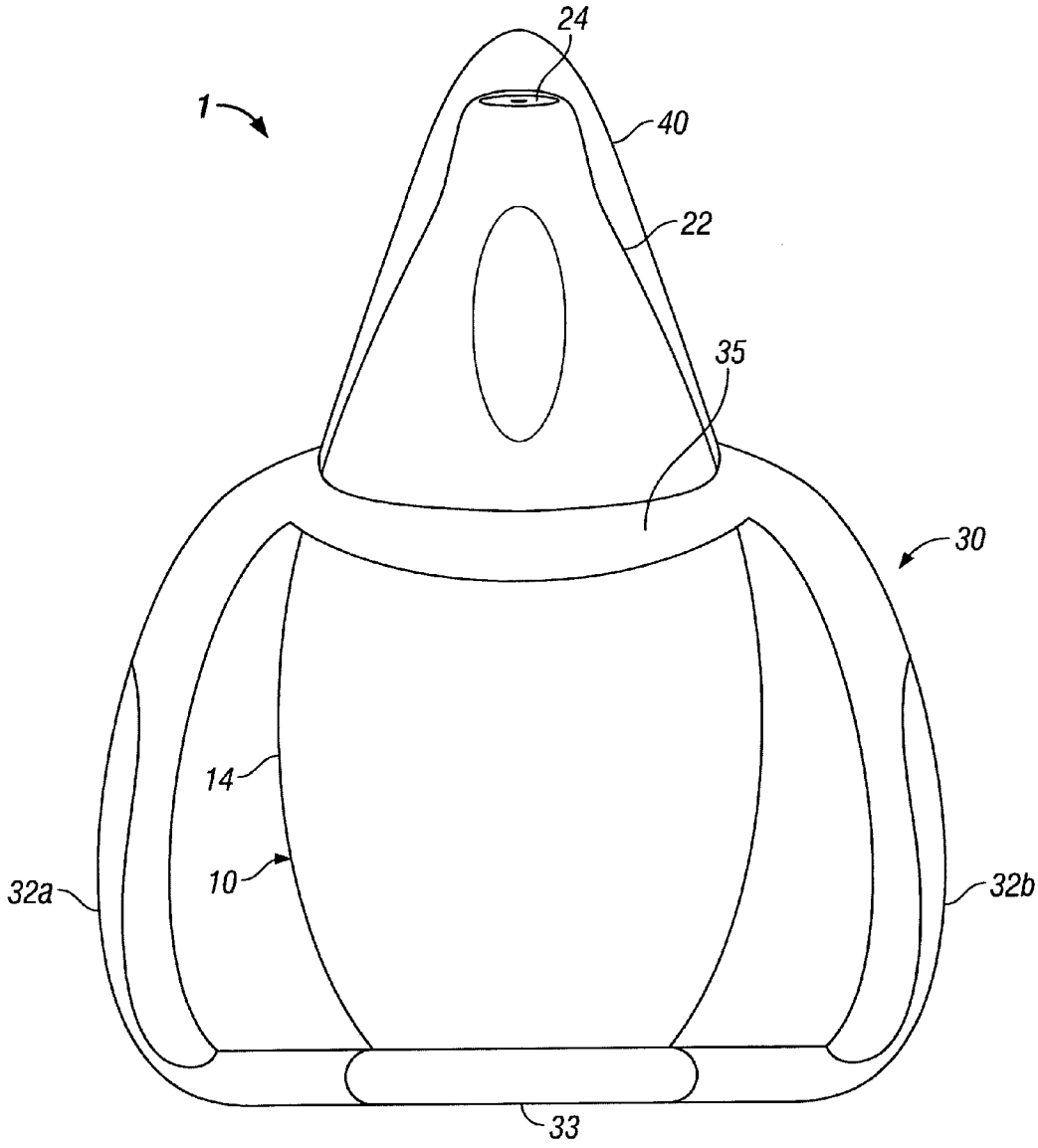
FIG. 1 shows a perspective view of infant drinking cup herein.
Figure 2:
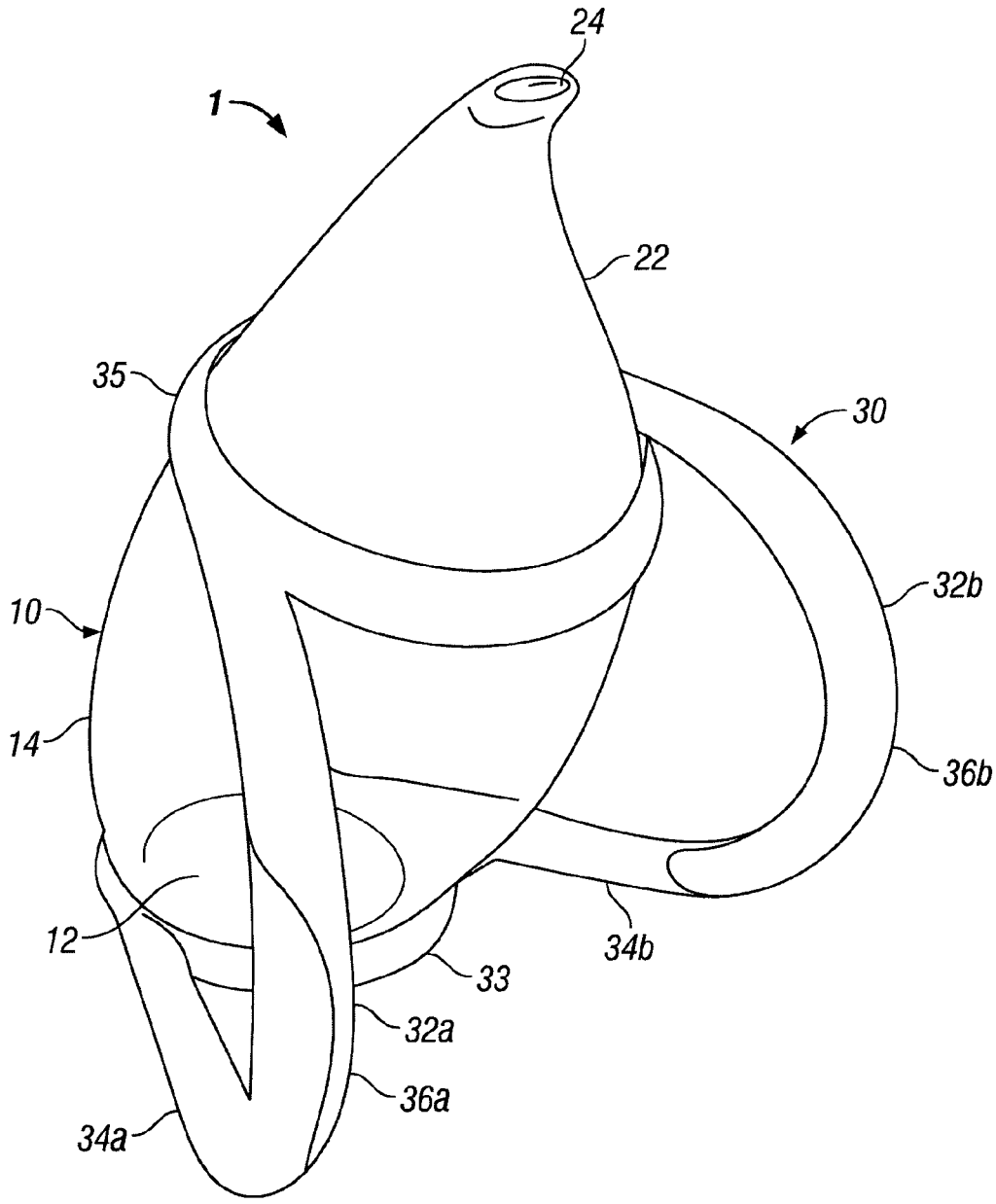
FIG. 2 shows a perspective view of the infant drinking cup of FIG. 1 now provided with an over-lid.
Figure 3:
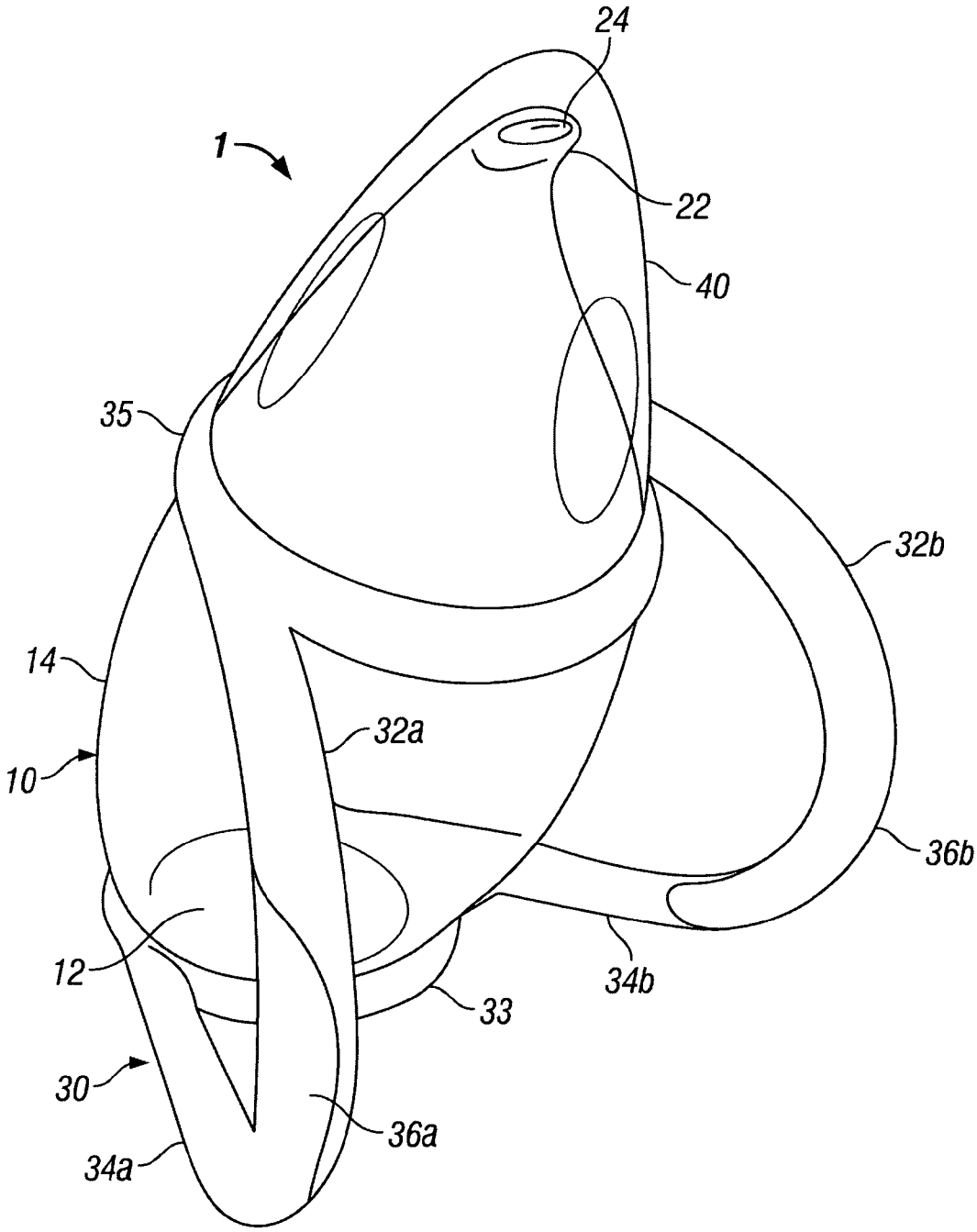
FIGS. 3 and 4 respectively show front and side views of the infant drinking cup with over-lid of FIG. 2.
Figure 4:
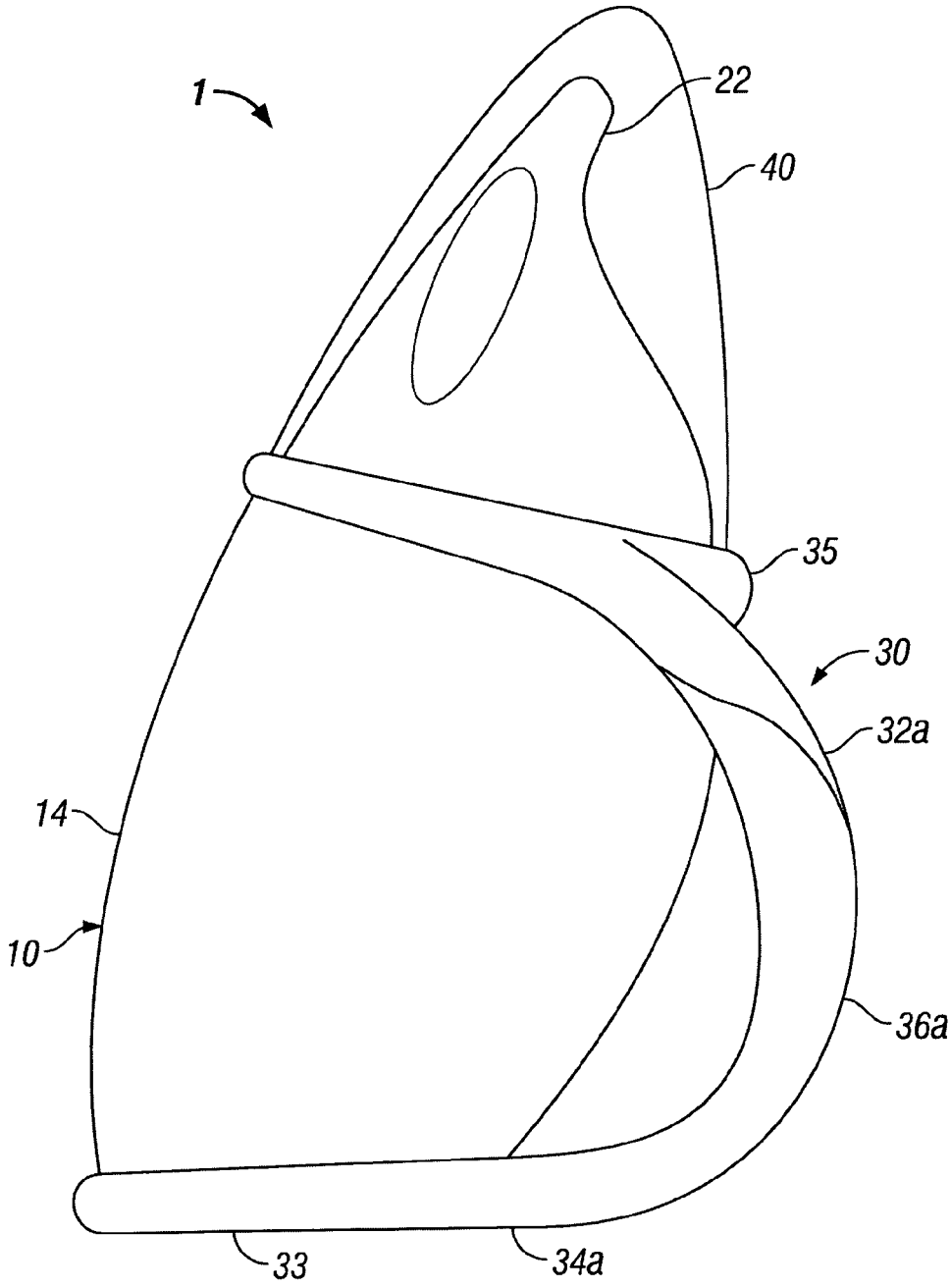
Figure 5:
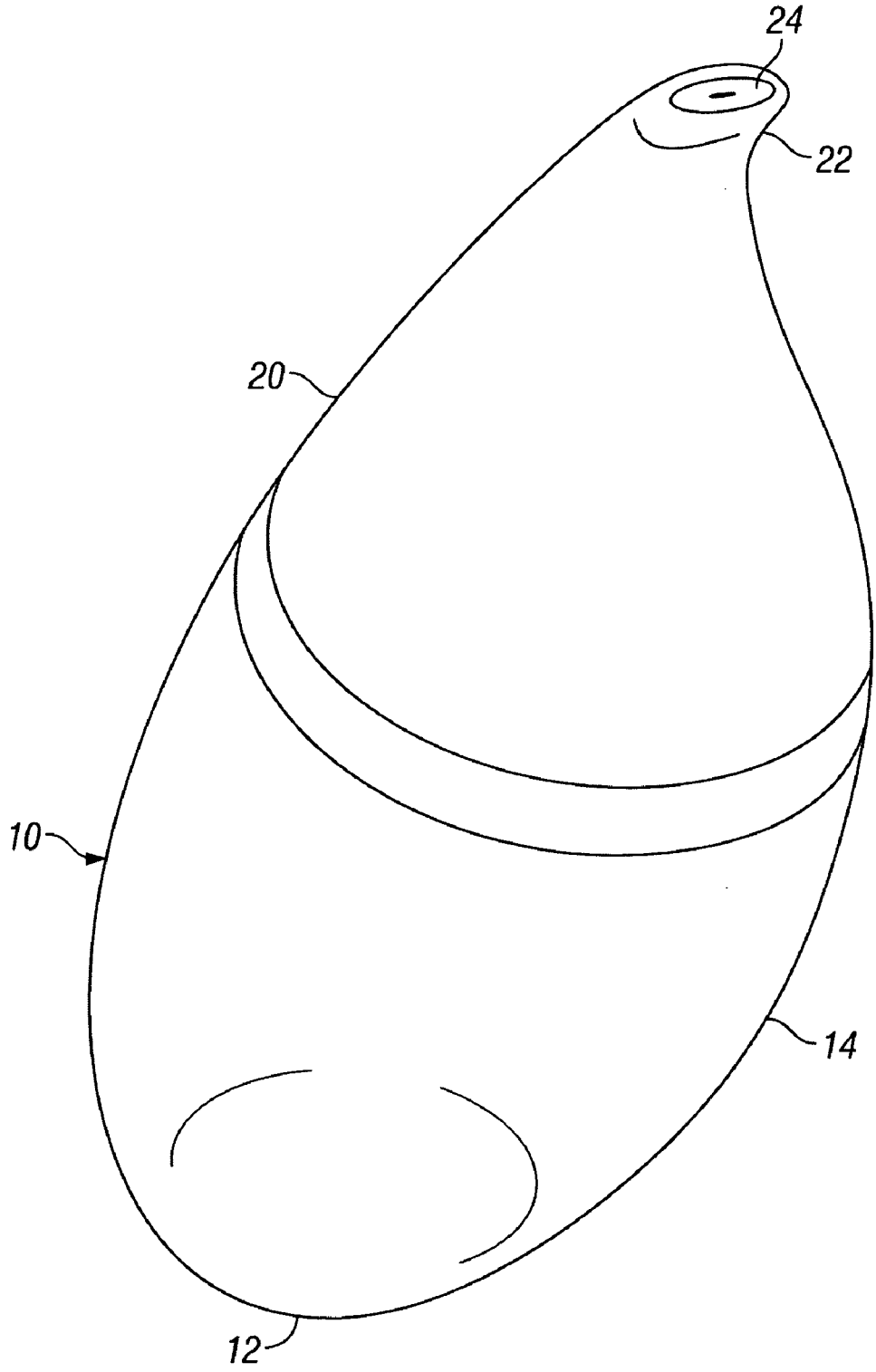
FIGS. 5 and 6 respectively show cup-shaped container and handle structures of the infant drinking cup of FIG. 1.
Figure 6:
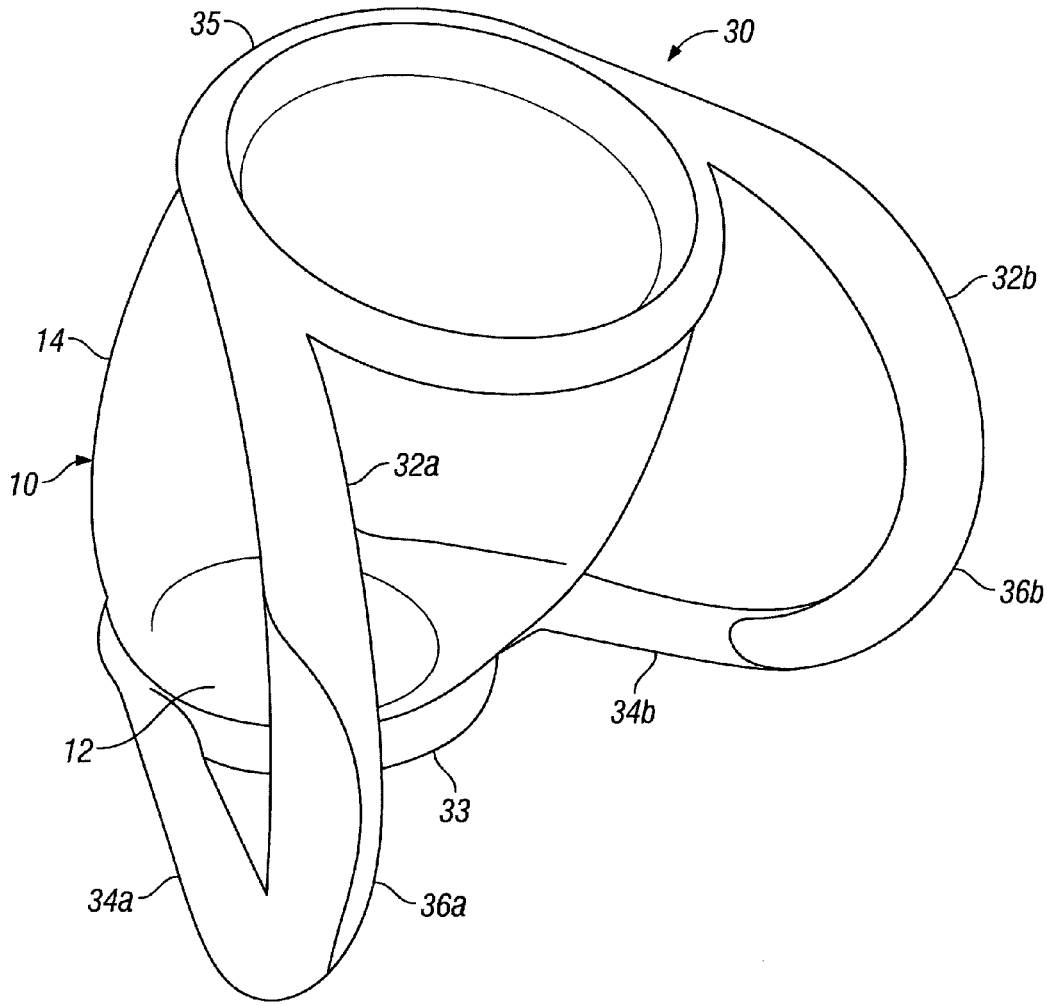

In more detail, the cup-shaped container 10 has a planar base 12 from which upwardly extends side wall 14 of circular cross-section, which side wall 14 defines a mouth 16 of the cup-shaped container 10. The side wall 14 centres about an axis that extends at an angle from normal to the planar base 12 such that the cup-shaped container 10 has a leaning form.

The cup-shaped container 10 is provided with a handle defining structure comprising a pair of handles 32*a*, 32*b* extending from a lower ring 33 provided to the base 12 of the cup-shaped container 10 to an upper ring 35 provided to the mouth 16 thereof. The handles 32*a*, 32*b* both project away from the cup-shaped container 10 about the general direction in which the cup-shaped container 10 leans. It will be appreciated that the handle structure 30 acts to support the cup-shaped container 10 to prevent accidental tipping over thereof.

In more detail, each handle 32*a*, 32*b* define a resting support portion 34*a*, 34*b* that extends in the plane defined by the base 12 and is arranged to define resting supporting contact with a planar support surface (e.g. a table top). Each handle 32*a*, 32*b* also defines a tipping support portion 36*a*, 36*b* that projects away from the resting support portions 34*a*, 34*b* thereof in or about the direction in which the cup-shaped container 10 leans and is arranged to define supporting contact with a planar support surface (e.g. a table top) when the cup-shaped container 10 is tipped up during use thereof.

Figure 7:
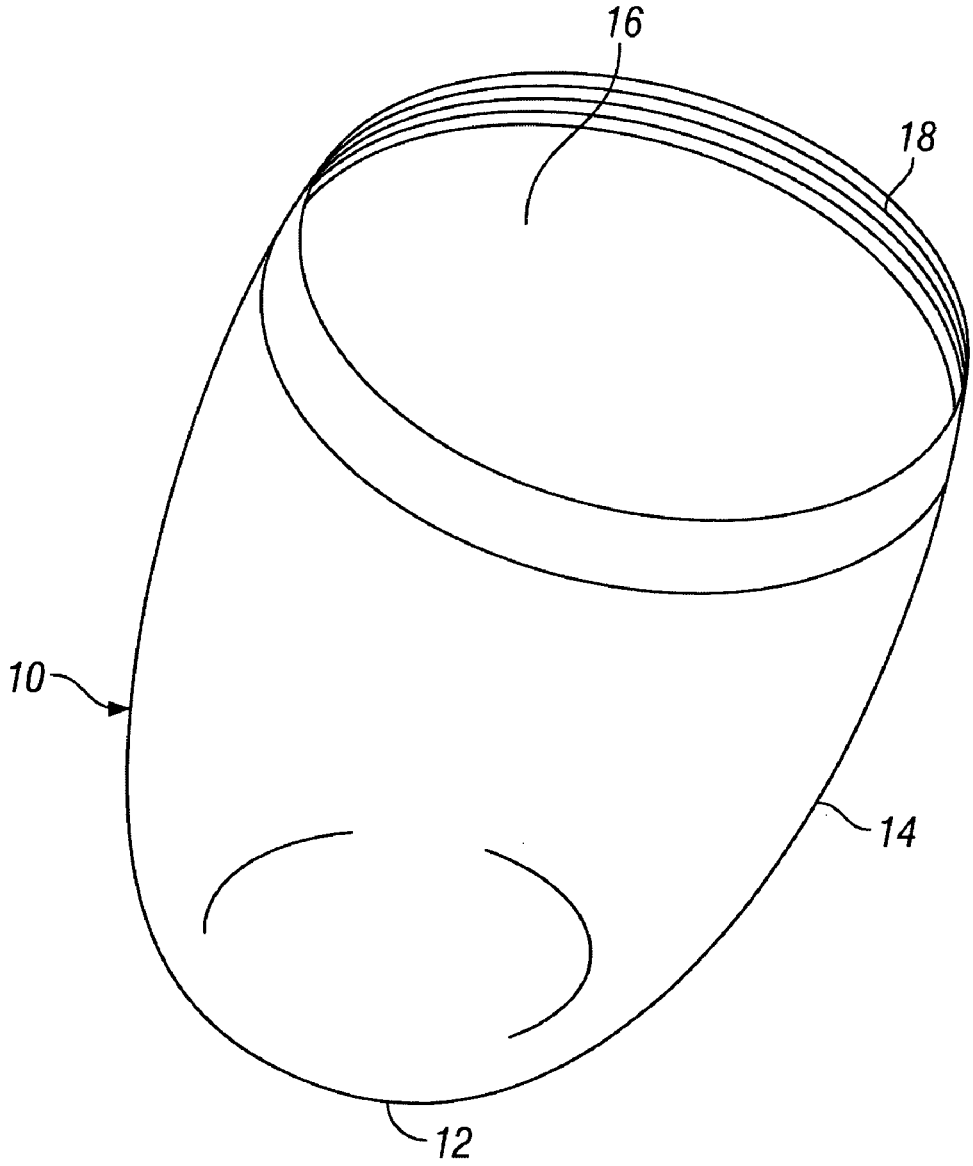
FIG. 7 shows the cup-shaped container of FIG. 5 absent its sealing lid.

The cup-shaped container 10 is further provided with a sealing lid 20 that interacts in a reversibly sealable manner therewith to seal off the mouth 16 thereof. As may be best seen in FIG. 7, the interior of the side wall 14 of the cup-shaped container 10 is provided with a screw-thread 18. The sealing lid 20 is provided with a mating screw-thread.

The sealing lid 20 is provided with a spout 22, and the spout is provided with a one-way valve 24. The sealing lid 20 with spout 22 is further provided with an over-lid 40 therefor.

The application of which this description and claims form part may be used as a basis for priority in respect of any subsequent application. The claims of such subsequent application may be directed to any feature or combination of features described therein. They may take the form of product, method or use claims and may include, by way of example and without limitation, one or more of the following claims:

The invention claimed is:

1. An infant drinking cup comprising (a) a cup-shaped container having a container base from which upwardly extends side walling, said container base defining a base plane and said side walling defining a mouth of said cup-shaped container, wherein the side walling centres about an axis that extends at an angle from normal to the container base such that the cup-shaped container has a leaning form; and (b) provided to the cup-shaped container, a handle defining structure comprising a pair of handles extending from a lower portion of the cup-shaped container to an upper portion thereof such that said pair of handles support the cup-shaped container to prevent accidental tipping over thereof, wherein the pair of handles extend from a lower ring provided to the container base of the cup-shaped container to an upper rind provided to the mouth of the cup-shaped container, and wherein the lower ring defines a resting support portion that extends in said base plane and is arranged to define resting supporting contact with a planar support surface, and wherein the pair of handles define a tipping support portion that projects away from said resting support portion in or about the direction in which the cup-shaped container leans and is arranged to define supporting contact with a planar support surface when the cup-shaped container is tipped up during use thereof, and wherein the cup-shaped container is separable from the handle defining structure.

2. An infant drinking cup according to claim 1, wherein the pair of handles extend from the base of the cup-shaped container around to the mouth thereof.

3. An infant drinking cup according to claim 1, wherein the cup-shaped container is provided with a sealing lid that interacts in a reversibly sealable manner therewith to seal off the mouth thereof.

4. An infant drinking cup according to claim 3, wherein the interior of the side walling of the cup-shaped container is provided with engaging means for engaging with the sealing lid.

5. An infant drinking cup according to claim 4, wherein said interior of the side walling of the cup-shaped container is provided with a screw-thread and the sealing lid is provided with a mating screw-thread.

6. An infant drinking cup according to claim 5, wherein said sealing lid is provided with a spout.

7. An infant drinking cup according to claim 4, wherein the spout is provided with a one-way valve.

8. An infant drinking cup according to claim 3, wherein the sealing lid with spout is provided with an over-lid therefor.

* * * * *